US009120664B2

(12) United States Patent
Birkler et al.

(10) Patent No.: US 9,120,664 B2
(45) Date of Patent: Sep. 1, 2015

(54) FUEL DISPENSING UNIT FOR REFUELING VEHICLES AND A METHOD FOR ASSEMBLING SUCH A FUEL DISPENSING UNIT

(75) Inventors: Annika Birkler, Malmo (SE); Paul De La Port, Austin, TX (US); Bengt I. Larsson, Skivarp (SE); Neil Thomas, Austin, TX (US); Kevin Christopher Burnett, Round Rock, TX (US); Hanna Helgesson, Dalby (SE); Scott R. Negley, Austin, TX (US)

(73) Assignee: Wayne Fueling Systems Sweden AB, Malmo (SE)

( * ) Notice: Subject to any disclaimer, the term of this patent is extended or adjusted under 35 U.S.C. 154(b) by 221 days.

(21) Appl. No.: 13/502,321

(22) PCT Filed: Oct. 16, 2009

(86) PCT No.: PCT/EP2009/063621

§ 371 (c)(1),
(2), (4) Date: Sep. 14, 2012

(87) PCT Pub. No.: WO2011/044953

PCT Pub. Date: Apr. 21, 2011

(65) Prior Publication Data

US 2013/0001246 A1 Jan. 3, 2013

(51) Int. Cl.

| | |
|---|---|
| ***B67D 7/06*** | (2010.01) |
| ***B67D 7/84*** | (2010.01) |
| ***B67D 7/40*** | (2010.01) |

(52) U.S. Cl.

CPC *B67D 7/84* (2013.01); *B67D 7/406* (2013.01); *Y10T 137/0402* (2015.04)

(58) Field of Classification Search

CPC ..... B67D 7/84; B67D 7/406; B67D 7/40; Y10T 137/0402

USPC ..... 222/74, 23, 192, 173, 530; 137/15.01; 141/382; 248/75

See application file for complete search history.

(56) References Cited

U.S. PATENT DOCUMENTS

| | | | | |
|---|---|---|---|---|
| 4,576,312 | A * | 3/1986 | Swick, Jr. | 222/27 |
| 4,611,729 | A * | 9/1986 | Gerstenmaier et al. | 222/75 |

(Continued)

FOREIGN PATENT DOCUMENTS

| | | | |
|---|---|---|---|
| GB | 2242889 | A | 10/1991 |
| WO | 03/095309 | A1 | 11/2003 |
| WO | 2009023782 | A1 | 2/2009 |

OTHER PUBLICATIONS

International Search Report dated Jul. 29, 2010 which was issued in connection with the WO Application No. PCT/EP2009/063621 which was filed on Oct. 16, 2009.

(Continued)

*Primary Examiner* — Kevin P Shaver
*Assistant Examiner* — Robert Nichols, II
(74) *Attorney, Agent, or Firm* — Mintz Levin Cohn Ferris Glovsky and Popeo, P.C.

(57) ABSTRACT

A fuel dispensing unit for refueling vehicles is provided that in one embodiment includes a base module containing dispensing hydraulics, an electronics module for controlling a fuel dispensing unit and having a user interface, a nozzle module for holding at least one nozzle for dispensing fuel from a fuel reservoir, a column module, and a top module. The electronics module is arranged above of the base module, the nozzle module is arranged above the base module, the column module is arranged above the nozzle module and the top module is arranged above the column module. Also provided is a method for assembling such a fuel dispensing unit.

15 Claims, 5 Drawing Sheets

(56) References Cited

U.S. PATENT DOCUMENTS

| | | | | |
|---|---|---|---|---|
| 5,083,846 | A * | 1/1992 | Day et al. | 312/321.5 |
| 5,452,750 | A | 9/1995 | Miller et al. | |
| 5,651,478 | A * | 7/1997 | Tatsuno | 222/25 |
| 6,167,922 | B1 * | 1/2001 | Seitz et al. | 141/97 |
| 6,328,060 | B1 * | 12/2001 | Smith | 137/355.2 |
| 6,786,250 | B2 * | 9/2004 | Stanley | 141/98 |
| 7,254,463 | B1 | 8/2007 | Moore | |
| 2008/0110981 | A1 * | 5/2008 | DeLine et al. | 235/381 |
| 2012/0211524 | A1 * | 8/2012 | Burnett et al. | 222/173 |

OTHER PUBLICATIONS

Office Action from corresponding CN Application No. 200980162963.9, dated Jul. 1, 2013.

* cited by examiner

FUEL DISPENSING UNIT FOR REFUELING VEHICLES AND A METHOD FOR ASSEMBLING SUCH A FUEL DISPENSING UNIT

TECHNICAL FIELD

The present invention relates to a fuel dispensing unit for refueling vehicles, comprising a base module containing dispensing hydraulics, an electronics module for controlling said fuel dispensing unit and having a user interface, a nozzle module for holding at least one nozzle for dispensing fuel from a fuel reservoir by means of said dispensing hydraulics, a column module, and a top module. The invention also relates to a method for assembling a fuel dispensing unit.

BACKGROUND ART

A fuel dispensing unit used for filling the fuel tank of a motor vehicle with fuel is a complex device containing a vast number of components connected to each other. The components of a fuel dispensing unit can be divided into two categories, the inner components which are not visual to a user and the outer components surrounding the inner components. The inner components typically comprise hydraulics and a tube arrangement for dispensing fuel from an underground fuel reservoir together with electronic components controlling the fuel dispensing unit. The outer components represent the fundamental structures of the fuel dispensing unit protecting and supporting the so important inner components. In view of the above, the number of components in a conventional fuel dispensing unit is very high. Due to this vast number of components required in a fuel dispensing unit, the costs for production and assembling is a constant issue in this line of business.

Traditionally, there has been a great focus on the inner components in the development of fuel dispensing units, and thus also when addressing the problem of production and assembling costs. Accordingly, the development of the outer components of a fuel dispensing unit has not kept up with the one of the inner components. This fact is obvious from the prior art in this technical field.

Thus, a problem with the fuel dispensing units today is the costs for producing and assembling the high number of components, especially in regard of the so called outer components since the development of the same has kept a proportionately slow pace.

SUMMARY OF THE INVENTION

It is an object of the present invention to provide an improvement over the prior art. More particularly, it is an object of the present invention to decrease the number of components in a fuel dispensing unit and to simplify the assembling of the same.

These and other objects as well as advantages that will be apparent from the following description of the present invention are achieved by a fuel dispensing unit and a method for assembling a fuel dispensing unit according to the independent claims.

Thus, a fuel dispensing unit is provided for refueling vehicles, comprising a base module containing dispensing hydraulics, an electronics module for controlling said fuel dispensing unit and having a user interface, a nozzle module for holding at least one nozzle for dispensing fuel from a fuel reservoir by means of said dispensing hydraulics, a column module, and a top module. Said electronics module is arranged above of said base module, said nozzle module is arranged above said base module, said column module is arranged above said nozzle module and said top module is arranged above said column module. This is advantageous in that the fundamental outer structure of the fuel dispensing unit is given a modular structure which in turn leads to a decreased number of components needed in order to achieve the fuel dispensing unit. Also, the same modules can be used to build several different variants of fuel dispensing units, which naturally heavily decrease the production and assembling costs. Another aspect is the specific vertical assembling of the modules, which in contrast to prior art structures with horizontal assembly, needs no horizontal connections (clean surfaces). This last aspect contributes to making the fuel dispensing unit easy to mount, thereby additionally decreasing the assembling costs of the same. Further, the fact that the modules according to the invention are arranged one above the other means that a joint between two modules has a horizontal extension, making said joint very easy to weather proof, e.g. by arranging the upper module such that it along said joint overlaps the lower module in the vertical direction.

The fuel dispensing unit may further comprise a reinforcing element extending from said base module to said column module, wherein said reinforcing element supports said column module. The object of the reinforcing element is to create an additional support structure for the column module in order to ensure the safety for the users and to create a more rigid fuel dispensing unit.

The reinforcing element may comprise a first protruding portion for supporting said column module, which is a simple and aesthetically pleasing way to provide the support needed for the column module.

The reinforcing element may be adapted to further support said nozzle module. The object of the reinforcing element is to create an additional support structure for nozzle module in order to ensure the safety for the users and to create a more rigid fuel dispensing unit.

The reinforcing element may further comprise a second protruding portion for supporting said nozzle module, which is a simple and aesthetically pleasing way to provide the support needed for the nozzle module.

The nozzle module may comprise protrusions projecting upwardly in a substantially vertical direction of said fuel dispensing unit, and said column module may comprise corresponding recesses for receiving said protrusions in order to position said column module in relation to said nozzle module. This is a way of creating a more secure and rigid interconnection between the column module and the nozzle module in a horizontal direction, which in turn contributes to an overall more secure and rigid fuel dispensing unit.

The column module may comprise protrusions projecting downwardly in a substantially vertical direction of said fuel dispensing unit, and said nozzle module may comprise corresponding recesses for receiving said protrusions in order to position said column module in relation to said nozzle module. This is a way of creating a more secure and rigid interconnection between the column module and the nozzle module in a horizontal direction, which in turn contributes to an overall more secure and rigid fuel dispensing unit.

The fuel dispensing unit may further comprise a tube arrangement and a hose connected thereto for transporting fuel from a fuel reservoir to said nozzle, wherein said tube arrangement extends from said base module to said nozzle module and said hose extends from said nozzle module to said nozzle via said column module and said top module.

The tube arrangement may also extend from said base module to said column module and said hose extends from said column module to said nozzle via said top module.

Lastly, the tube arrangement may extend from said base module to said top module and said hose extends from said top module to said nozzle.

These three examples of the extension of the tube arrangement and the hose are advantageous in that the hose may be given a suitable length without creating the problem of the hose lying on the ground when not in use. This is of great importance since a hose lying on the ground risks being run over by a vehicle. Another aspect is the safety measures, if the hose is very short, the vehicle to be refueled must be placed very close to the fuel dispensing unit and thereby risks colliding with it. Accordingly, the hose must present a certain length in order to be user-friendly for a user refueling a vehicle. With this solution there is no need for an extracting or retracting device in order to control the hose when pulled from an idle position to an operating position or the other way around.

The tube arrangement may be at least partly enclosed by said base module, said nozzle module, said column module and/or said top module. This is advantageous in that the tube arrangement is given a safe path through the modules without the need for additional components. Accordingly, the fuel dispensing unit is minimized and the number of components is additionally decreased.

A through opening may be provided in said electronics module separating said user interface from said base module, which is advantageous in that the user is given the possibility to see through the fuel dispensing unit. The element of surprise for a potential thief sneaking behind the fuel dispensing unit can thereby be avoided. The through opening may also be used for providing a ventilation zone for electrical wires extending from the base module to the electronics module.

The base module and/or said top module comprise display surfaces for prints, which creates a large and elevated position for advertising or possible for information.

The top module may be adapted to receive an at least partly enclosing display module which comprises display surfaces for prints, which creates a large and elevated position for advertising or possible for information.

The top module may further comprise a retracting device connected to said hose in order to reduce the stress of said hose during use. The retracting device is adapted to retract the hose from an operating position to an idle position.

The retracting device may be any one chosen from the group consisting of a resilient member, a string and a weight, and a fluid filled cylinder, which is advantageous in that the fuel dispensing unit can be adapted after different requests.

According to a second aspect of the present invention, the invention relates to a method for assembling a fuel dispensing unit, comprising providing a base module on a suitable location for the fuel dispensing unit, arranging a nozzle module above said base module, arranging a column module above said nozzle module, arranging a top module above said column module, and arranging an electronics module above said base module. This is advantageous in that the fundamental outer structure of the fuel dispensing unit is given a modular structure which in turn leads to a decreased number of components needed in order to achieve the fuel dispensing unit. Also, the same modules can be used to build several different variants of fuel dispensing units, which naturally heavily decrease the production and assembling costs. Another aspect is the specific vertical assembling of the modules, which in contrast to prior art structures with horizontal assembly, needs no horizontal connections (clean surfaces). This last aspect contributes to making the fuel dispensing unit easy to mount, thereby additionally decreasing the assembling costs of the same. Further, the fact that the modules according to the inventive method are arranged one above the other means that a joint between two modules has a horizontal extension, making said joint very easy to weather proof, e.g. by arranging the upper module such that it overlaps the lower module along said joint in the vertical direction.

The method may further comprise arranging a reinforcing element for supporting said column module and/or said nozzle module. The object of the reinforcing element is to create an additional support structure for column module in order to ensure the safety for the users and to create a more rigid fuel dispensing unit.

Generally, all terms used in the claims are to be interpreted according to their ordinary meaning in the technical field, unless explicitly defined otherwise herein. All references to "a/an/the [element, device, component, means, etc.]" are to be interpreted openly as referring to at least one instance of said element, device, component, means, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF PREFERRED EMBODIMENTS OF THE INVENTION

Figure 1:
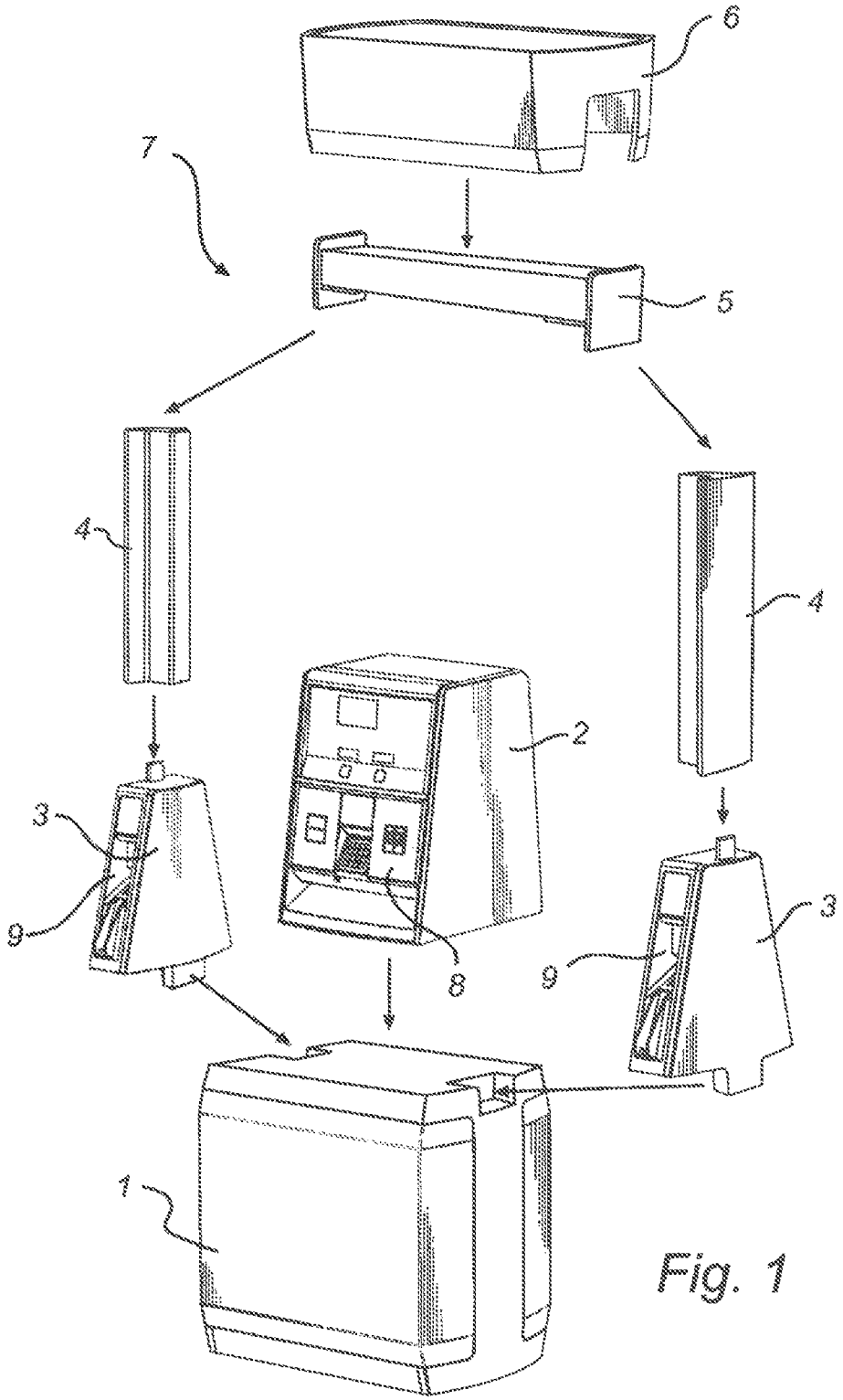
FIG. 1 is a perspective view of a fuel dispensing unit according to a first embodiment of the invention when unassembled.

FIG. 1 illustrates six different types of modules 1, 2, 3, 4, 5, 6 of a fuel dispensing unit 7 before being assembled. The modules 1, 2, 3, 4, 5, 6 are constituted by a base module 1, an electronics module 2, two nozzle modules 3, two column modules 4, a top module 5 and a display module 6.

The electronics module 2 is arranged above of the base module 1, the nozzle module 3 is arranged above the base module 1, the column module 4 is arranged above the nozzle module 3 and the top module 5 is arranged above said column module.

The arrangement of one module above or on top of another module results in joints between modules extending in a horizontal direction.

The base module 1 contains the hydraulics (not shown) of the fuel dispensing unit 7, such as fuel metering means, valves, pumps, vapor recovery system, etc. The exterior of the base module 1 comprises display surfaces for prints. The electronics module contains means for controlling the fuel dispensing unit 7 and comprises a user interface 8 on one of its outer surfaces. The user interface 8 is adapted to show pump data and is equipped to handle payment for fuel after refueling. Each one of the nozzle modules 3 holds two nozzle boots 9, one on each side of the nozzle module 3, which nozzle boots 9 are intended to carry a nozzle 10, respectively. The column modules 4 are to be arranged above or on top of the nozzle module 3 in order to elevate and support the top module 5 when assembled. The top module 5 itself comprises display surfaces for prints. However the top module 5 is also adapted to receive a display module 6, which in turn comprises display surfaces for prints. The electronics module 2 may be provided with lateral arrangements containing for instance electrical wiring. Said lateral arrangements may be received in correspondingly shaped recesses in the nozzle module 3.

Figure 2:
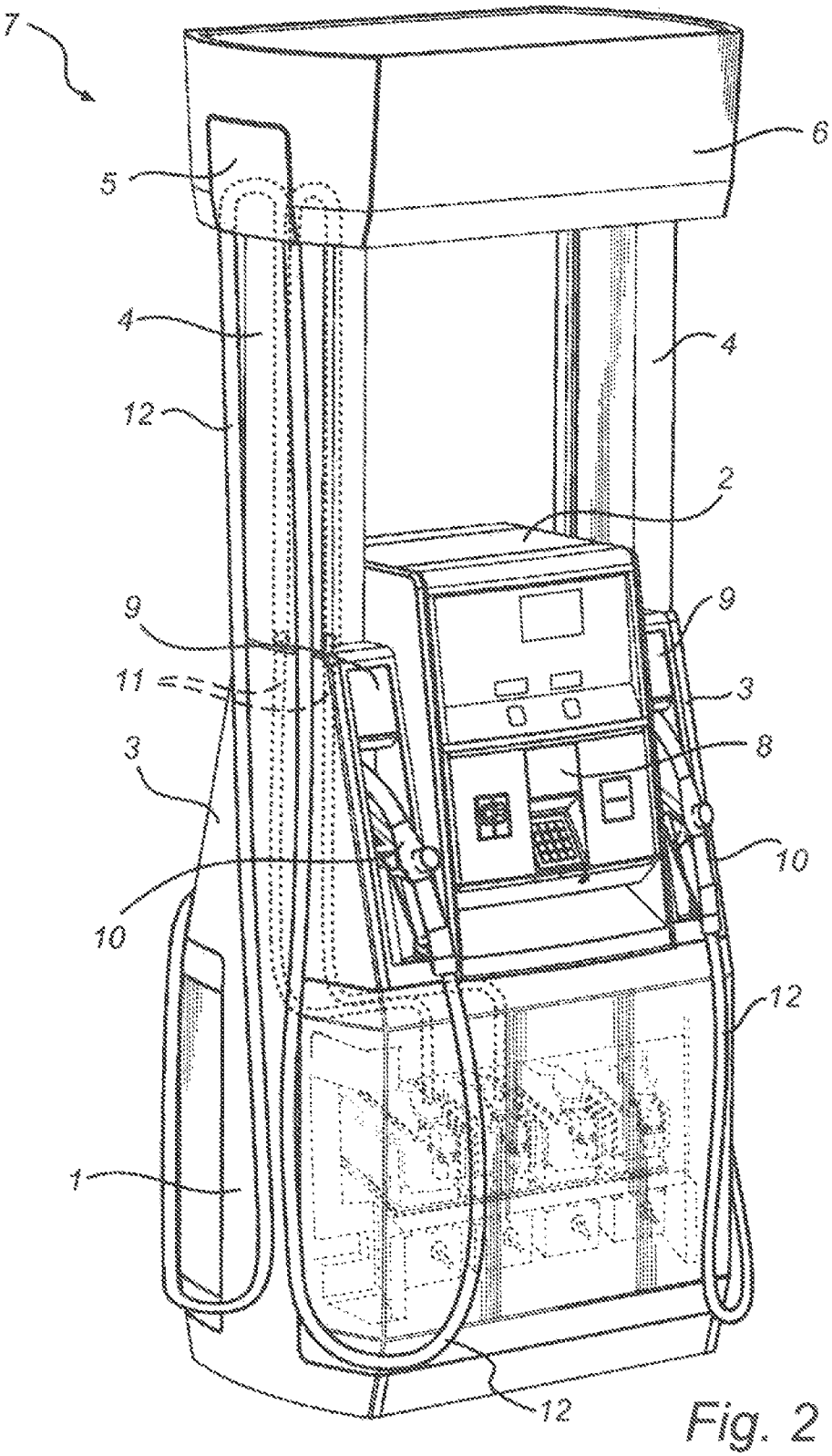
FIG. 2 is a perspective view of the fuel dispensing unit in FIG. 1 when assembled.

In FIG. 2, the fuel dispensing unit 7 is illustrated when assembled. The base module 1 is positioned on the ground in a suitable location for the fuel dispensing unit 7. The electronics module 2 is arranged on top of the base module 1, whereby the user interface 8 will be located in a suitable height for a user of the fuel dispensing unit 7. A through opening is provided in the electronics module 2 separating said user interface 8 from said base module 1. Two nozzle modules 3 are arranged on top of the base module 1, one on each side of the electronics module 2. Each nozzle module 3 carries two nozzle boots 9 located opposite to each other and adapted to receive a nozzle 10, respectively. A column module 4 is arranged on top of each one of the nozzle modules 3. The two column modules 4 in turn carry a top module 5, which is arranged on top of the two column modules 4. A display module 6 is arranged at the top module 6, which display module 6 partly surrounds the top module 5. The display module 6 comprises display surfaces for prints.

The fuel dispensing unit 7 has a tube arrangement 11 and a hose 12 connected thereto for transporting fuel from an underground fuel reservoir (not shown) to the nozzle 10. The tube arrangement 11 extends from the underground fuel reservoir to and through the nozzle module 3. Above the nozzle module 3, the tube arrangement 11 is connected to the hoses 12 belonging to that particular side of the fuel dispensing unit 7. The same connection between the tube arrangement 11 and the hoses 12 is made in the nozzle module 3 located on the other side of the fuel dispensing unit 7. The hoses 12 then in turn extend from the nozzle module 3 to a respective nozzle 10 via the column module 4 and the top module 5. This way, the tube arrangement 11 is enclosed by the base module 1, the nozzle module 3, and the hoses 12 are partly enclosed by the column module 4 and the top module 5. The tube arrangement 11 may, however, extend from said base module 1 to the column module 4 and be connected to the hoses in the column module 4. The hoses 12 then extend from the column module 4 to the nozzles 10 via the top module 5. Another possibility is for the tube arrangement 11 to extend from the base module 1 all the way to the top module 5. With this solution the hoses 12 then extend directly from the top module 5 to the nozzles 10.

Figure 3:
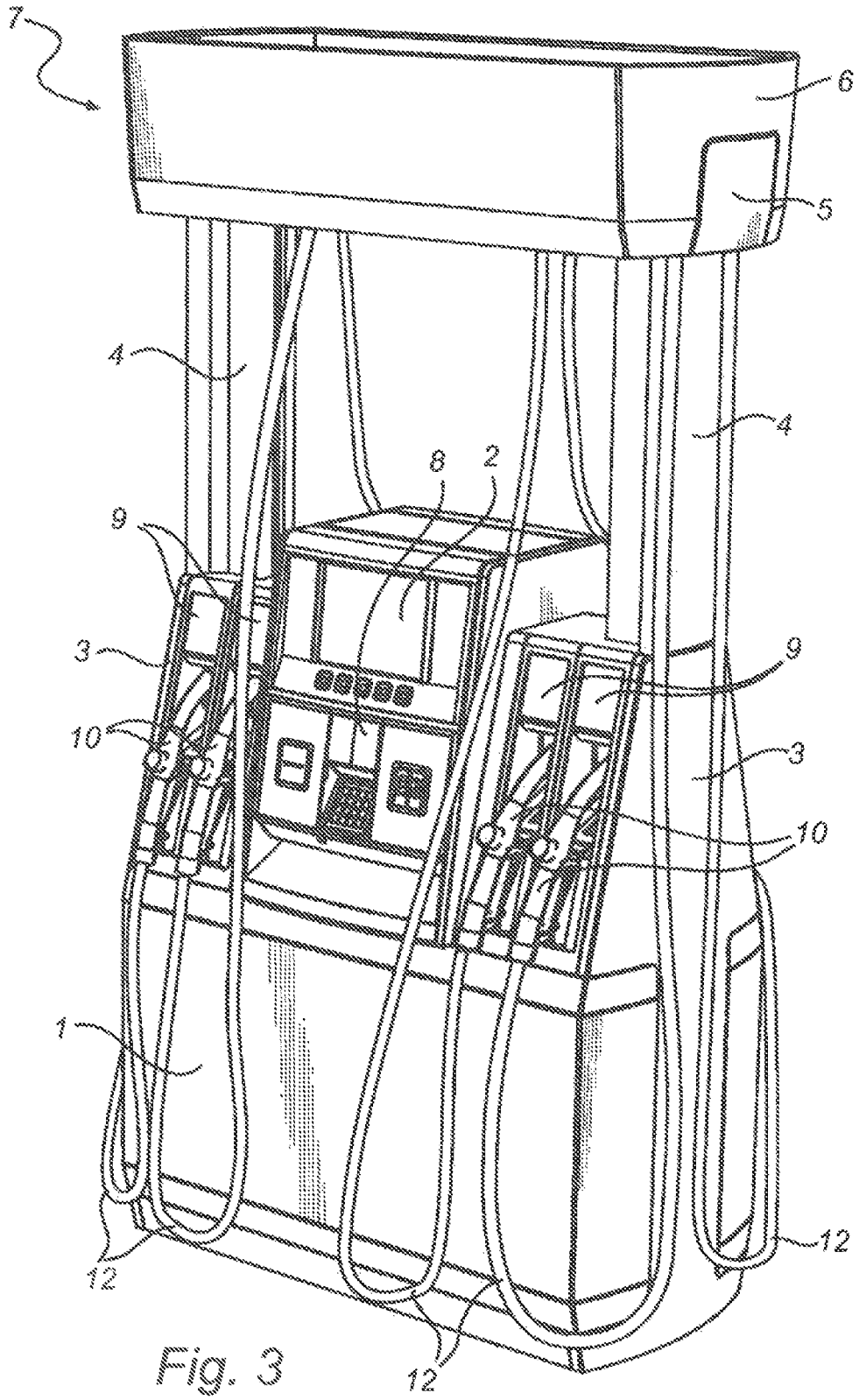
FIG. 3 is a perspective view of the fuel dispensing unit according to a second embodiment of the invention.

FIG. 3 illustrates a fuel dispensing unit 7 according to a second embodiment of the invention. In this fuel dispensing unit, each nozzle module 3 holds four nozzle boots 9, two on each side of the nozzle module 3. Accordingly, this fuel dispensing unit overall carries eight nozzles 10.

Figure 4:
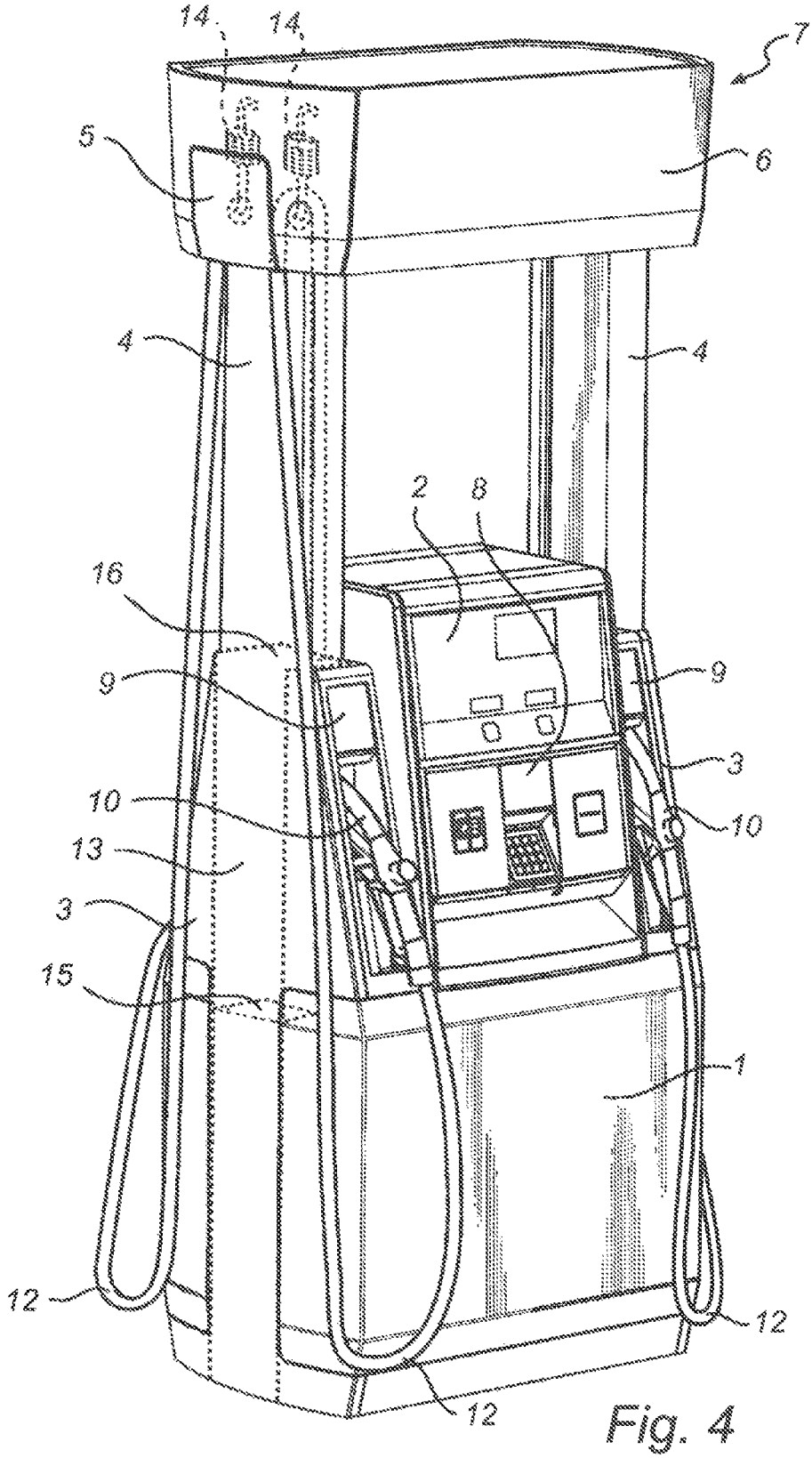
FIG. 4 is a perspective view of the fuel dispensing unit according to the first embodiment of the invention, further comprising a reinforcing element and a retracting device.

In FIG. 4 a couple of additional features are disclosed in connection with a fuel dispensing unit 7 according to the first embodiment of the invention illustrated in FIG. 4.

One of the additional features relates to two reinforcing elements 13 arranged one on each side of the fuel dispensing unit 7. The other additional feature relates to four retracting devices 14, one for each hose 12. An inventive fuel dispensing unit 7 may be equipped with one or both of said additional features.

The fuel dispensing unit 7 may also be provided with a damping device. Since the hose may be connected to the top module of the fuel dispensing unit, a significant moment can be created when the hose connected in such a way is pulled from its idle position. In order to reduce the amount of stress exerted on the hose, or the connection of the hose, said retracting device is provided. The reinforcing element 13 extends from the base module 1 to the column module 4 on each side of the fuel dispensing unit 7. Each reinforcing element 13 has a first and a second protruding portion 15, 16 for supporting the nozzle module 3 and the column module 4.

The retracting devices 14 are attached to the top module 5 of the fuel dispensing unit 7 and to the hoses 12. When the nozzle 10 is pulled from its idle position, the retracting device 14 works as a resilient element for the hose 12 in order to reduce the amount of stress exerted on the hose 12, or the connection of the hose 12, on which the retracting device 14 is provided. The retracting device 14 may for example be a resilient member, a string and a weight, or a fluid filled cylinder.

Figure 5:
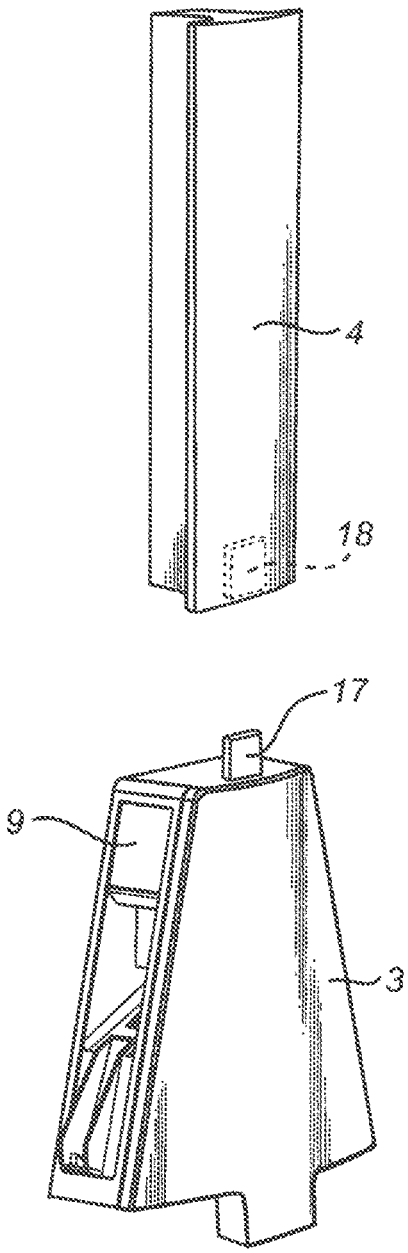
FIG. 5 is a perspective view of a nozzle module and a column module according to one embodiment of the invention.

FIG. 5 illustrates the nozzle module 3 and the column module 4 according to one embodiment of the invention. The nozzle module 3 has a protrusion 17 projecting upwardly in a substantially vertical direction of the fuel dispensing unit 7, and the column module 4 has a corresponding recess 18 for receiving the protrusion 17 of the nozzle module 3, in order to position the column module 4 in relation to the nozzle module 3. The extension of the protrusion 17 may of course be varied. In one embodiment, the protrusion 17 extends throughout the entire length of the column module 4 and into the top module 6. In another embodiment, the protrusions 17 extend substantially throughout the length of the column module 4. Also, nozzle module 3 may be provided with a plurality of protrusions 17.

Figure 6:
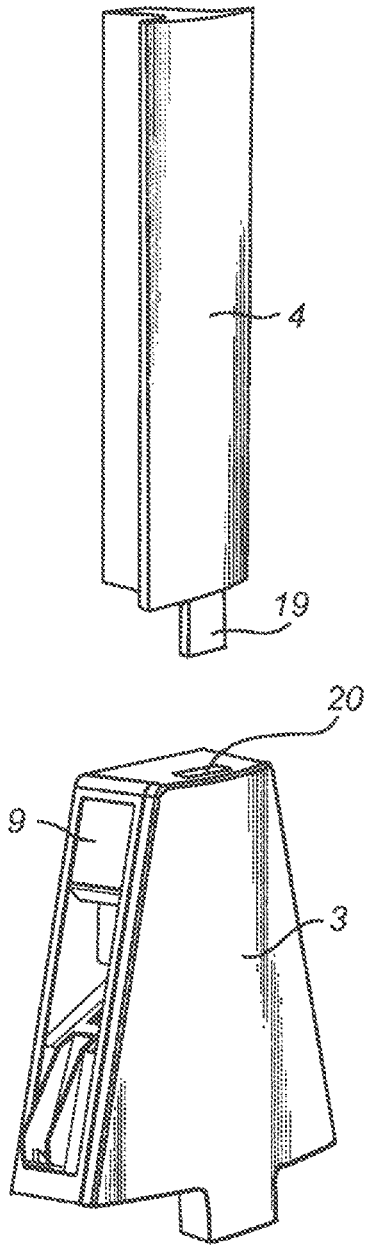
FIG. 6 is a perspective view of the nozzle module and the column module according to another aspect of the invention.

In FIG. 6 the nozzle module 3 and the column module 4 are illustrated according to another embodiment of the invention. The column module 4 has a protrusion 19 projecting downwardly in a substantially vertical direction of the fuel dispensing unit 7, and the nozzle module 3 has a corresponding recess 20 for receiving the protrusion 19, in order to position the column module 4 in relation to the nozzle module 3. The extension of the protrusion 19 may of course be varied. In one embodiment, the protrusion 19 extends throughout the entire length of the nozzle module 3 and into the base module 1. In another embodiment, the protrusion 19 extends substantially throughout the length of the nozzle module 3. Also, column module 4 may be provided with a plurality of protrusions 19.

When a user is refueling the tank of a motor vehicle, the fuel is pumped from the underground reservoir by means of a pump (not shown) which is located in the base module 1, and from there to the tube arrangement 11 and out to the nozzle 10 via the hose 12.

When refueling does not take place, the hoses 12 hangs from the top module 5 and the nozzles 10 are inserted in the nozzle boots 9.

The size and shape of the different modules 1, 2, 3, 4, 5, 6 and the other components of the fuel dispensing unit 7 may of course be varied without departing from the scope of protection of the claims.

The column modules 4 may have grooves in a vertical direction of the fuel dispensing unit 7 for guiding the hoses 12 between the nozzle module 3 and the top module 5.

The reinforcing element 13 may have several additional protrusions in order to be able to sufficiently support the nozzle module 3 and the column module 4. Also, the reinforcing element 13 may be located within the fuel dispensing unit 7 as well as outside of the fuel dispensing unit 7. The protrusion 15 may extend across the base module 1 and interconnect with the corresponding protrusion 15 on the opposite side of the fuel dispensing unit 7. Another possibility is to have one single reinforcing element 13 for both sides of the fuel dispensing unit 7.

The modules may each be provided with a lower circumferential collar extending in the vertical direction. Hereby it will be possible to arrange an upper module above a lower module such that the lower collar of the upper module overlaps the joint between the two modules. As a result, a reliable weather proofing of the joint is achieved.

According to a second aspect of the invention a method is provided for assembling a fuel dispensing unit 7.

The invention has mainly been described above with reference to a few embodiments. However, as is readily appreciated by a person skilled in the art, other embodiments than the ones disclosed above are equally possible within the scope of the inventions, as defined by the appended claims.

The invention claimed is:

1. A fuel dispensing unit for refueling vehicles, comprising:

a base module containing dispensing hydraulics, an electronics module for controlling said fuel dispensing unit and having a user interface, a nozzle module for holding at least one nozzle for dispensing fuel from a fuel reservoir by means of said dispensing hydraulics, said nozzle module arranged horizontally to a side of said electronics module, a column module, and a top module, wherein said electronics module is arranged vertically above said base module, said nozzle module is arranged vertically above said base module, said column module is arranged vertically above said nozzle module, and said top module is arranged vertically above said column module such that said column module elevates and supports said top module, wherein the nozzle module includes a vertical mating connection for vertically mating to the base module and the column module, and wherein the vertical mating connection comprises protrusions formed on the nozzle module and projecting in a substantially vertical direction, and wherein the base module and the column module include corresponding recesses for receiving said protrusions.

2. The fuel dispensing unit of claim 1, further comprising a reinforcing element extending from said base module to said column module, wherein said reinforcing element supports said column module.

3. The fuel dispensing unit of claim 2, wherein said reinforcing element comprises a first protruding portion for supporting said column module.

4. The fuel dispensing unit of claim 3, wherein said reinforcing element is adapted to further support said nozzle module.

5. The fuel dispensing unit of claim 4, wherein said reinforcing element further comprises a second protruding portion for supporting said nozzle module.

6. The fuel dispensing unit of claim 1, further comprising a tube arrangement and a hose connected thereto for transporting fuel from a fuel reservoir to said nozzle, wherein said tube arrangement extends from said base module to said top module and said hose extends from said top module to said nozzle module.

7. The fuel dispensing unit of claim 6, wherein said tube arrangement extends from said base module to said column module and said hose extends from said column module to said nozzle via said top module.

8. The fuel dispensing unit of claim 6, wherein said tube arrangement extends from said base module to said top module and said hose extends from said top module to said nozzle.

9. The fuel dispensing unit of claim 6, wherein said tube arrangement at least partly enclosed by said base module, said nozzle module, said column module and/or said top module.

10. The fuel dispensing unit of claim 6, wherein said top module further comprises a retracting device connected to said hose in order to reduce the stress of said hose during use.

11. The fuel dispensing unit of claim 10, wherein said retracting device is selected from the group consisting of a resilient member, a string and a weight, and a fluid filled cylinder.

12. The fuel dispensing unit of claim 1, wherein a through opening is provided in said electronics module separating said user interface from said base module.

13. The fuel dispensing unit of claim 1, wherein said base module and/or said top module comprise display surfaces.

14. The fuel dispensing unit of claim 1, wherein said top module is adapted to receive an at least partly enclosing display module which comprises display surfaces.

15. A fuel dispensing unit for refueling vehicles, the fuel dispensing unit comprising:

a base module containing dispensing hydraulics, an electronics module for controlling the fuel dispensing unit and having a user interface, a nozzle module for holding at least one nozzle for dispensing fuel from a fuel reservoir by means of the dispensing hydraulics, the nozzle module arranged horizontally to a side of the electronics module, a column module, and a top module, wherein the electronics module is arranged vertically above the base module, the nozzle module is arranged vertically above the base module, the column module is arranged vertically above the nozzle module, and the top module is arranged vertically above the column module such that the column module elevates and supports the top module, wherein the nozzle module includes a vertical mating connection for vertically mating to the base module and the column module, and wherein the mating connection comprises recesses formed in the nozzle module, and corresponding protrusions on the base and column modules projecting in a substantially vertical direction.

* * * * *